US007362989B2

(12) United States Patent
Nishihama et al.

(10) Patent No.: US 7,362,989 B2
(45) Date of Patent: Apr. 22, 2008

(54) DEVELOPING APPARATUS FOR IMAGE FORMING APPARATUS

(75) Inventors: Tadayoshi Nishihama, Abiko (JP); Fumitake Hirobe, Ushiku (JP); Akinori Tanaka, Kashiwa (JP); Akihiro Noguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/246,184

(22) Filed: Oct. 11, 2005

(65) Prior Publication Data

US 2006/0083554 A1 Apr. 20, 2006

(30) Foreign Application Priority Data

Oct. 20, 2004 (JP) ..... 2004-306178

(51) Int. Cl.
*G03G 15/08* (2006.01)

(52) U.S. Cl. ..... 399/258; 399/120; 399/255

(58) Field of Classification Search ..... 399/258, 399/259, 260, 120, 255
See application file for complete search history.

(56) References Cited

U.S. PATENT DOCUMENTS 5,526,099 A * 6/1996 Katakabe ..... 399/258
6,122,472 A * 9/2000 Sako et al. ..... 399/254
6,975,825 B2 12/2005 Sakamaki et al. ..... 399/269
7,046,945 B2 5/2006 Nishitani et al. ..... 399/254
2004/0086301 A1 5/2004 Tamura ..... 399/227
2004/0223788 A1* 11/2004 Awaya ..... 399/227
2006/0088341 A1 4/2006 Noguchi et al. ..... 399/258

FOREIGN PATENT DOCUMENTS

JP 2003-84555 3/2003
JP 2004-133339 4/2004
JP 2004-151586 5/2004

* cited by examiner

*Primary Examiner*—David M. Gray
*Assistant Examiner*—Joseph S. Wong
(74) *Attorney, Agent, or Firm*—Fitzpatrick, Cella, Harper & Scinto

(57) ABSTRACT

The developing apparatus includes developer containing parts and a replenishment portion. The developer containing parts contains a developer circularly conveyed in the developer containing parts. The replenishment portion includes a replenish aperture and a regulation surface. The replenishment portion merges a replenishment agent passing through the regulation surface with the developer in the developer containing part. In the developing apparatus, a wall surface of the replenishment portion, located on a downstream side in a developer conveyance direction in the developer containing part facing to the replenishment portion, is formed by being inclined with respect to the developer conveyance direction.

8 Claims, 11 Drawing Sheets

DEVELOPING APPARATUS FOR IMAGE FORMING APPARATUS

BACKGROUND OF THE INVENTION

1. Field of the Invention

The present invention relates to a developing apparatus used for pieces of image forming apparatus such as a copying machine and a printer utilizing an electrophotographic or electrostatic recording method in which an image is formed by developing an electrostatic image formed in an image bearing member with a developer.

2. Related Background Art

Conventionally a two-component developer mainly containing toner particles (toner) and carrier particles (carrier) is widely used for the developing apparatus included in the electrophotographic or electrostatic recording type image forming apparatus. Particularly, in the color image forming apparatus forming a full-color or multi-color image, the two-component developer is used in almost all of the pieces of developing apparatus.

As is well known, toner density of the two-component developer, i.e., a ratio of a toner weight to the total weights of the carrier and the toner (TD ratio) is an extremely valuable factor in stabilizing image quality. The two-component developer toner is consumed during development, and the toner density is changed. Therefore, the color image forming apparatus is provided with developer density detection means for detecting the toner density of the two-component developer accommodated in a developing container of the developing apparatus (developing apparatus main body) and control means for replenishing, the toner to the developing container according to a detected signal. Thus, usually a developer density control apparatus is provided in the color image forming apparatus to keep the toner density of the two-component developer constant.

A replenishment agent (generally toner) whose replenishment amount is controlled by the control means from a replenish aperture into the developing container through a replenishment agent supply path (toner replenishing path). The replenish aperture is a connection portion between the replenishment agent supply path and the developing container. Then, the replenishment agent is stirred and mixed with a conveyance member (usually screw) such that the toner density of the two-component developer becomes substantially uniform. The conveyance member is provided in the developing container.

In the pieces of conventional developing apparatus disclosed in Japanese Patent Application Laid-Open (JP-A) No. 2004-151586, JP-A No. 2004-133339, and JP-A No. 2003-84555, as shown in FIGS. 11 and 12, usually a falling and conveyance direction of the replenishment agent is a perpendicular direction in the replenish aperture. That is, conventionally the replenishment agent usually enters a developer containing part of the developing container while falling from the replenishment agent supply path and the replenishment agent goes down on a developer surface on the conveyance member in the developer containing part.

In a configuration in which a replenishment agent supply direction is perpendicular to the replenish aperture, namely, in the configuration in which the replenish aperture is located directly above the conveyance member in the developer containing part and the replenishment agent reaches the developer surface on the conveyance member while falling, there is the following problem. For example, when the full-color image forming apparatus provides for further multi colors (at least five colors) such as six colors while conventionally the four-color developing apparatus for yellow, magenta, cyan, and black is usually provided, sometimes the replenishment agent supply path interferes with the adjacent developing apparatus.

Therefore, as shown in FIG. 1, (1) sometimes the replenishment agent supply path is arranged at a position shifted from directly above the conveyance member in the developer containing part to supply the replenishment agent through a slope extending from the replenish aperture located with an inclination above the conveyance member.

It is also thought that the developing apparatus is miniaturized to arrange the replenishment agent supply path directly above the conveyance member in the developer containing part However, the miniaturization of the developing apparatus leads to a decrease in developer amount in the developing apparatus. This means that a fluctuation in toner density of the developer is increased by the toner consumption during the image formation, and the fluctuation in toner density causes a fluctuation in image density or a fluctuation in tint. Therefore, usually it is preferable that the replenishment agent supply path interference problem is solved by a method other than the miniaturization of the developing apparatus.

Further, there is the method in which the degraded carrier is recovered in each small amount and the carrier is replenished by newly mixing the carrier in the replenishment agent for the recovered carrier, and thereby the trouble of developer exchange is avoided while performance of the carrier which is of a charge imparting agent is maintained to some extent. Recently the adoption of this method is increasing. In this case, (2) the carrier is supplied while mixed in the toner which is of the replenishment agent. With reference to the carrier replenishment method, the carrier may independently be replenished, and the replenish aperture dedicated to the carrier may be provided in order to independently replenish the carrier.

However, in the case of the adoption of (1) the method of replenishing the replenishment agent through the slope or (2) the configuration in which at least the carrier is contained in the replenishment agent, it is found that there is a fear that clogging of the replenishment agent is generated near the replenish aperture to disrupt the supply of the replenishment agent.

It is though that the clogging of the replenishment agent near the replenish aperture is generated by a mechanism described below but not limited to the following mechanism.

As shown in FIG. 13, near the replenish aperture, a marginal stream is generated in association with a developer conveyance flow S0 in the developer containing part in a replenishment portion A including a slope for controlling the replenishment agent conveyance (falling) direction. The marginal stream includes a marginal stream (S1) in which a part of the developer conveyance flow S0 enters the replenishment portion A to become the marginal stream and a marginal stream (S2) in which the replenishment agent is accelerated to become the marginal stream by flowing the developer conveyance flow S0.

The marginal streams collide with a wall surface (hereinafter referred to as downstream side wall surface) W of the replenishment portion A located on the downstream side in the developer conveyance direction in the developer containing part, and the marginal streams rebound toward the opposite direction to the developer conveyance flow (S3). The downstream side wall surface W faces the replenishment portion A. Hereinafter the developer rebounding from the downstream side wall surface W is referred to as rebound developer.

Sometimes the following problems are caused by the marginal streams:

(i) in the case of a shape in which the rebound developer is difficult to return into the developer containing part due to a gravity, the rebound developer is easy to stay within the replenishment portion A, and (ii) when the rebound developer has a high carrier content, the amount of rebound developer is increased because the carrier having a rebound coefficient higher than that of the toner is increased in the marginal stream.

When at least one of these two kinds of phenomena (i) and (ii) becomes prominent, the replenishment agent supply path is gradually clogged up, and thee is a fear that the supply of the replenishment agent is blocked.

Therefore, it is necessary to avoid the interruption of the supply of the replenishment agent to the developer containing part without clogging the replenishment agent near the replenish aperture despite of (1) the conveyance (falling) direction of the replenishment agent from the replenish aperture or (2) the carrier content in the replenishment agent.

SUMMARY OF THE INVENTION

An object of the invention is to provide a developing apparatus which can suppress the clogging of the replenishment agent in the supply path of the replenishment agent to the developer containing part.

In order to achieve the above object, a developing apparatus according to the invention includes a developer containing part which accommodates a developer, the developer being conveyed in the developer containing part; a replenishment agent supply path which supplies a replenishment agent to the developer containing part through a replenish aperture; and a replenishment portion which has a regulation surface, the replenishment agent supplied from the replenish aperture slipping down on the regulation surface, the replenishment portion merging the replenishment agent with the developer in the developer containing part, wherein a wall surface located on a downstream side in a developer conveyance direction in the developer containing part is formed by being inclined with respect to the developer conveyance direction in the replenishment portion.

DETAILED DESCRIPTION OF THE EMBODIMENTS

A developing apparatus and an image forming apparatus according to the invention will be described in detail with reference to the accompanying drawings.

First Embodiment

Overall Configuration and Action of Image Forming Apparatus

Figure 1:
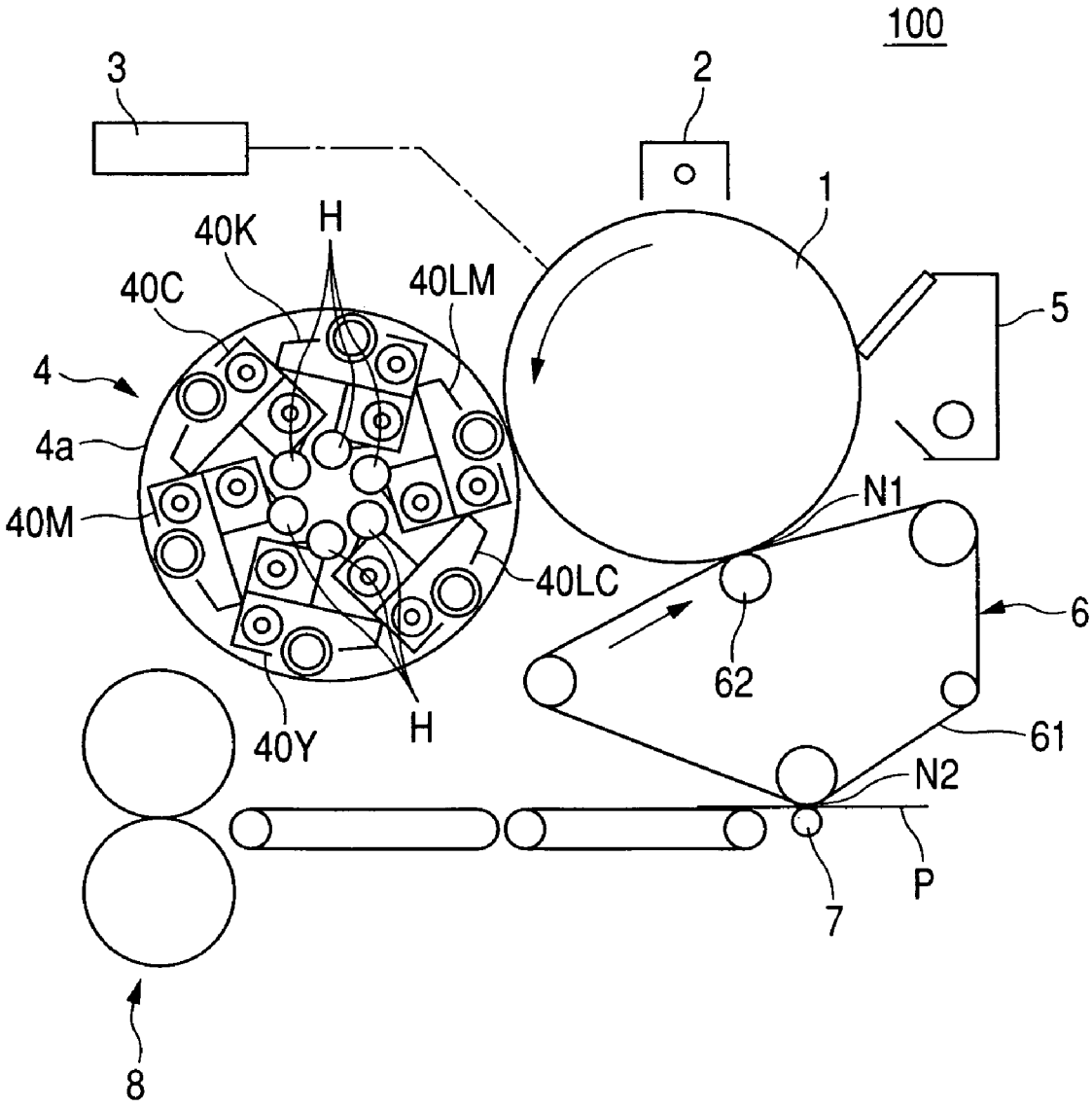
FIG. 1 is a schematic sectional view showing an image forming apparatus according to a first embodiment of the invention.

Referring now to FIG. 1, an overall configuration and an action of an image forming apparatus according to a first embodiment will be described. FIG. 1 is a longitudinal sectional view showing the schematic overall configuration of the image forming apparatus of the first embodiment. An image forming apparatus 100 of the first embodiment is an electrophotographic laser beam printer in which an intermediate transferring method is adopted. The image forming apparatus 100 performs the image formation according to image information signals from a host device such as a personal computer connected to the image forming apparatus main body or an original reading apparatus connected to the image forming apparatus main body. At this point, the full-color image is formed on a recording medium (recording sheet, plastic film, cloth, and the like) by six-color developers of light magenta (LM), light cyan (LC), yellow (Y), magenta (M), cyan (C), and black (K).

The image forming apparatus 100 includes a cylindrical rotatable electro-photosensitive member (hereinafter referred to as photosensitive drum) 1 which is of an image bearing member. A charging device (corona discharge device) 2 which is of charging means, a rotary developing apparatus 4, a cleaner 5 which is of cleaning means, and an intermediate transferring unit 6 are arranged around the photosensitive drum 1. A laser scanner 3 which is of exposure means is also arranged which being able to perform the scan-exposure on the photosensitive drum 1.

In the rotary developing apparatus 4, a rotating member (rotary) 4*a* which is of a developing apparatus holding member has a black developing apparatus 40K, a yellow developing apparatus 40Y, a magenta developing apparatus 40M, a cyan developing apparatus 40C, a light magenta developing apparatus 40LM, and a light cyan developing apparatus 40LC. The rotating member 4*a* is rotated about a rotating shaft (not shown), which moves each developing apparatus. When the light magenta toner image is formed on the photosensitive drum 1, the development is performed with the light magenta developing apparatus 40LM at a development position close to the photosensitive drum 1. Similarly when the light cyan toner image is formed, the rotating member is rotated by 60°, and the light cyan developing apparatus 40LC is arranged at the development position to perform the development. The toner image formation is similarly performed in yellow, magenta, cyan, and black.

The intermediate transferring unit 6 includes an intermediate transferring belt 61 which is of an intermediate transferring member. The intermediate transferring belt 61 is entrained about plural rollers so as to be able to be rotated. A primary transferring roller 62 which is of a primary transferring means is arranged at an opposite position to the photosensitive drum 1 through the intermediate transferring belt 61.

For example, the full-color image formation with six-color developers will be explained as an example of an image forming action. First a surface of the rotating photosensitive drum 1 is evenly charged by the charging device 2. Then, the surface of the photosensitive drum 1 charged by the charging device 2 is scan-exposed with the laser beam from the laser scanner 3 according to the image information, which results in the formation of the electrostatic image (latent image) on the photosensitive drum 1. The predetermined color-separation developing apparatus corresponding to the electrostatic image is moved to the development position opposing the photosensitive drum 1 by rotating the rotary developing apparatus 4 in an arrow direction, and the predetermined developing apparatus is operated to develop the electrostatic image formed on the photosensitive drum 1. For example, as shown in FIG. 1, the light magenta developing apparatus 40LM is arranged at the development position, and the light magenta toner image is formed on the photosensitive drum 1 by developing the electrostatic image formed on the photosensitive drum 1 according to the light magenta image information.

At a primary transferring portion N1 where the primary transferring roller 62 and the photosensitive drum 1 are opposite to each other through the intermediate transferring belt 61, the toner image formed on the photosensitive drum 1 is transferred onto the intermediate transferring belt 61 by action of a transferring bias applied to the primary transferring roller 62.

The full-color toner image in which the six-color developers are sequentially superposed is formed on the intermediate transferring belt 61 by performing the above actions for the six colors.

At a secondary transferring portion N2 where a secondary transferring roller 7 which is of secondary transferring means and the intermediate transferring belt 61 are opposite to each other, the six-color toner image formed on the intermediate transferring belt 61 is transferred to a recording material P in a collective manner by the action of a secondary transferring bias applied to the secondary transferring roller 7 which is of secondary transferring means. At this point, the recording material P is synchronized with the toner image on the intermediate transferring belt 61 and conveyed to the secondary transferring portion N2 by recording material conveyance means (not shown).

Then, the recording material P is separated from the intermediate transferring belt 61 and conveyed to a fixing device 8 which is of fixing means. The recording material P is pressurized and heated by the fixing device 8, and the toner image is fixed as a permanent image onto the recording material P. After the primary transferring process, adherents (transfer residual toner and the like) remaining on the photosensitive drum 1 are removed by a cleaner 26.

Configuration and Action of Developing Apparatus

Figure 2:
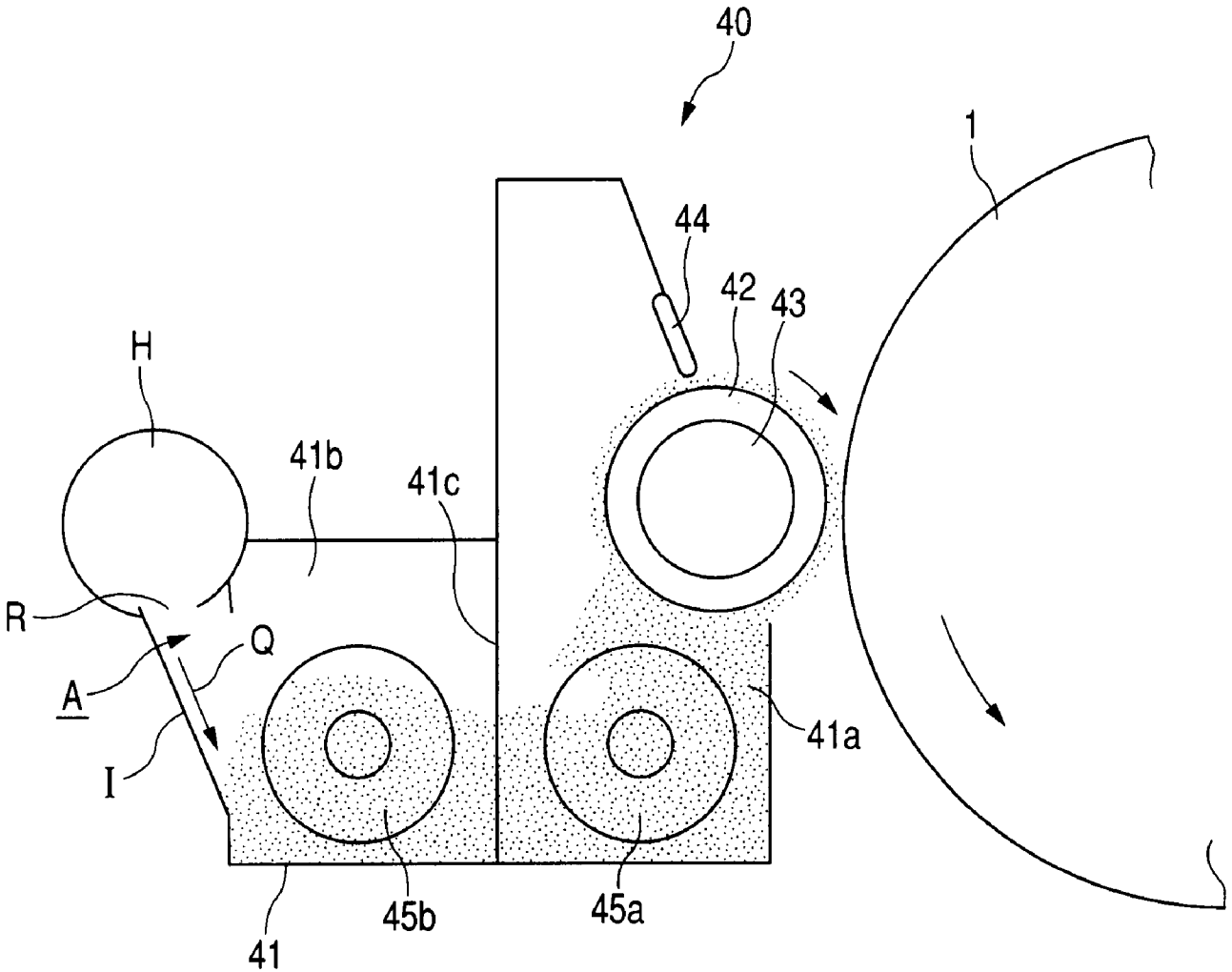
FIG. 2 is a schematic sectional view showing a developing apparatus according to the first embodiment of the invention.

Then, the developing apparatus will further be described with reference to FIGS. 2 and 3. In the first embodiment, the configurations and actions of the six-color pieces of developing apparatus are similar to one another except that the developing colors are different from one another. Accordingly, when the distinction is not particularly required, the developing apparatus will collectively be described while neglecting the subscripts LM, LC, Y, M, C, and K given to the numeral in order to indicate the element belonging to which color developing apparatus. FIG. 2 shows a developing apparatus 40 arranged at the development position.

As shown in FIG. 2, the developing apparatus 40 has a developing container (developing apparatus main body) 41 which accommodates a two-component developer. The two-component developer includes non-magnetic toner particles (toner) and magnetic carrier particles (carrier). In the developing container 41, a development area opposing the photosensitive drum 1 is opened, and a developing sleeve 42 which is of a developer bearing member is rotatably arranged so as to be exposed to this opening portion. In the first embodiment, the developing sleeve 42 is made of a non-magnetic material, and a magnet 43 which is of magnetic field generating means is included in the developing sleeve 42. The developing sleeve 42 is rotated in the arrow direction in FIG. 2 during the developing action, and the developing sleeve 42 conveys the two-component developer to the development area opposing the photosensitive drum 1 while holding the two-component developer in the developing container 41 in a laminar form. At this point, the developer amount on the developing sleeve 42 is regulated in association with the rotation of the developing sleeve 42 by a regulation blade 44 which is of a developer amount regulation member. The toner in the developer is transferred onto the photosensitive drum 1 according to the electrostatic image formed on the photosensitive drum 1, and the electrostatic image is developed as the toner image. After the development of the electrostatic image, the developer is conveyed according to the rotation of the developing sleeve 42 and recovered into the developing container 41.

Usually a developing bias in which direct-current voltage is superposed to alternating voltage is applied to the developing sleeve 42 from developing bias generating means (not shown). In the first embodiment, a waveform of an alternating component is a rectangular wave, a frequency is 2 kHz, and Vpp is 2 kV. An alternating electric field is formed between the developing sleeve 42 and the photosensitive drum 1 by the developing bias, and the toner is electrically separated from the carrier to form toner mist, which improves development efficiency.

The inside of the developing container 41 is partitioned into a developing room (first room) 41*a* which is of the developer containing part and an agitation room (second room) 41*b* by a partition 41*c* extending in the perpendicular direction. The two-component developer including the toner and the carrier is accommodated in the developing room 41*a* and the agitation room 41*b*.

A first conveyance member (first screw) 45*a* and a second conveyance member (second screw) 45*b* which are formed in a screw type are arranged in the developing room 41*a* and the agitation room 41*b* respectively. The first screw 45*a* arranged near the developing sleeve 42 agitates the developer in the developing room 41*a* and conveys the developer toward a longitudinal direction of the developing sleeve 42. The developer conveyed in the developing room 41*a* is supplied onto the developing sleeve 42. Under the control of ATR, the second screw 45*b* agitates and conveys the replenishment agent and the developer already existing in the agitation room 41*b* to homogenize the toner density. As described later, the replenishment agent (including the toner and the carrier in the first embodiment) is supplied through a replenish aperture R. The replenish aperture R is provided near the upstream end in the developer conveyance direction by the second screw 45*b* in the agitation room 41*b*. Therefore, the toner replenished by the supply of the replenishment agent through the replenish aperture R is sufficiently agitated and mixed with the developer in the agitation room

41*b* by the second screw 45*b*, and then the toner can be transferred to the developing room 41*a*.

Developer passages 41*d* and 41*e* (FIG. 3) are formed in the partition 41*c*. The developer passages 41*d* and 41*e* mutually communicate the developing room 41*a* and the agitation room 41*b* at end portions on a front side and a back side in the paper of FIG. 2. Therefore, in the developing room 41*a*, the developer whose toner density is decreased by the consumption in the developing process is moved into the agitation room 41*b* through the developer passage 41*d* (on the front side of FIG. 2) by conveyance forces of the first screw 45*a* and the second screw 45*b*. The developer in the agitation room 41*b*, in which the toner is replenished by the supply of the replenishment agent and the agitation is performed, is also moved to the developing room 41*a* through the other developer passage 41*e*(on the back side in the paper of FIG. 2).

In a bottom portion in the developing room 41*a*, the first screw 45*a* is arranged in substantially parallel with an axis line (development width direction) of the developing sleeve 42. In the first embodiment, the first screw 45*a* is formed in a screw structure in which a blade member is provided in a spiral fashion around the rotating axis. The rotation of the first screw 45*a* conveys the developer in the developing room 41*a* toward the axis line direction of the developing sleeve 42.

In the first embodiment, the second screw 45*b* is formed in the same screw structure as the first screw 45*a*, i.e., in the screw structure in which the blade member is provided in the spiral fashion around the rotating axis, and the second screw 45*b* is arranged in the bottom portion in the agitation room 41*b* in substantially parallel with the first screw 45*a*. The second screw 45*b* conveys the developer in the agitation room 45*b* to ward the opposite direction to the first screw 45*a*.

Thus, the developer is circulated between the developing room 41*a* and the agitation room 45*b* by the rotations of the first screw 45*a* and the second screw 45*b*.

The two-component developer used in the first embodiment will further be described. The toner whose volume average grain size is about 8 μm is used. The toner is obtained by grinding and classifying a material in which a resin binder mainly containing polyester and pigments are kneaded.

The volume average grain size of the toner is measured by the following apparatus and method. A Coulter counter TA-II (product of Beckman Coulter, Inc.) is used as a measuring apparatus, and an interface (product of Nikkaki Co.) and a personal computer CX-1 (product of Canon) are used in order to output a number average distribution and a volume average distribution. An 1% NaCl aqueous solution prepared with primary sodium chloride is used as an electrolytic aqueous solution. The measuring method will be described below. That is, a surface active agent is added as a dispersing agent to the electrolytic aqueous solution. Preferably, 0.1 ml of alkylbenzenesulfonic acid and 0.5 to 50 mg of a measurement sample are added to 100 to 150 ml of the electrolytic aqueous solution. A dispersing treatment is performed to the electrolytic aqueous solution in which the sample is suspended for about 1 to 3 min, and the grain size distribution of the particles ranging from 2 to 40 mm is measured to determine the volume average distribution with the Coulter counter TA-II in which a 100 mm aperture is used as an aperture. The volume average grain size is obtained from the volume average distribution determined above-described manner.

The carrier in which a core mainly made of ferrite is coated with a silicone resin is used, and the carrier whose 50% grain size ($D_{50}$) is 40 μm is used.

The toner and the carrier are mixed together with a weight ratio of the toner and the carrier is about 8:92, and used as the two-component developer having the 8% toner density (TD ratio).

The toner, in which pigment parts are adjusted such that optical densities become 0.8 and 1.6 per toner amount of 0.5 mg/cm$^2$ on the recording material P respectively, are used as the light-colored toner and the deep-color toner. Specifically, in the first embodiment, the light-colored toner (LM and LC) is prepared by decreasing the deep-color toner (M and C) of the pigment part to one-fifth.

Auto Toner Replenisher (ATR)

Then, an auto toner replenisher (ATR) in the first embodiment will be described.

The image forming apparatus 100 of the first embodiment includes ATR which automatically replenishes the replenishment agent into the developing container 41 according to the toner amount consumed by the development such that the toner density of the two-component developer always becomes the desired value in the developing container 41.

A replenishment agent supply path H is coupled to the developing container 41. The replenishment agent supply path H timely and substantially quantitatively conveys and supplies the replenishment agent including the toner amount to be replenished to the developing container 41. A replenishing member (not shown), which is formed in the screw in the first embodiment, is provided in the replenishment agent supply path H. The predetermined amount of replenishment agent can be supplied into the developing container 41 by driving the replenishing member by a predetermined amount.

A developer replenishment tank (not shown) is connected to the replenishment agent supply path H. The whole or a part of the developer replenishment tank is formed as a toner bottle (toner cartridge) while being detachable to the image forming apparatus main body. The developer replenishment tank is changed when the replenishment agent in the bottle runs out. Alternatively, the developer replenishment tank is fixed to the image forming apparatus main body, and the new replenishment agent is replenished in the developer replenishment tank when the replenishment agent runs out. A supply path of the replenishment agent from the replenishment agent supply path H to the developing container 41 of the developing apparatus 40 will be described in detail later.

For example, a CPU which is of control means functions as ATR control means. The CPU is included in an engine control unit which totally controls the action of the image forming apparatus 100. The control means computes the amount of replenishment agent to be replenished to the developing container 41 based on a detection signal from a toner density detection sensor which detects the toner density of the developer in the developing container 41. Examples of the toner density detection sensor include a reflected light quantity detection type toner density detection sensor and an inductance detection type toner density detection sensor. The replenishing member of the replenishment agent supply path H is driven by the predetermined amount (for a predetermined time) according to the computed amount of replenishment agent. Typically the toner density of the developer is kept constant by replenishing the toner such that the toner density of the developer is kept constant in the developing container 41, which allows the desired image density to be obtained.

ATR is not limited to the method of computing the replenishment agent amount according to the result in which the toner density detection sensor directly detects the toner density of the developer in the developing container 41. As is well known among those skilled in the art, there is the so-called patch detection type ATR. In the patch detection type ATR, a density detection reference image (toner image) is formed on the photosensitive member which is of the image bearing member, the intermediate transferring member, and the recording material bearing member, and the density of the reference image is detected with an optical reflection type detection sensor or the like, which allows the toner density to be indirectly detected. Further, there is the so-called video count type ATR which computes the toner consumption amount by integrating density information in each pixel of the formation image. Any type ATR can be used in the invention, and the usable ATR can appropriately be used.

[Replenishment Agent Clogging Near Replenish Aperture]

The supply path of the replenishment agent from the replenishment agent supply path H to the developing container 41, which is the most characteristic in the first embodiment, will be described below.

As described above, in the case of the adoption of (1) the method of replenishing the replenishment agent through the slope or (2) the configuration in which at least the carrier is contained in the replenishment agent, it is found that there is a fear that the clogging of the replenishment agent is generated near the replenish aperture to disrupt the supply of the replenishment agent.

1. Clogging of Replenishment Agent by Replenishing Path of Replenishment Agent

In the first embodiment, when the toner is consumed by the image formation, the consumed amount of toner is replenished from the developer replenishment tank (not shown) through the replenishment agent supply path H.

As shown in FIG. 1, in the first embodiment, due to the provision for the six colors, it is necessary that the six pieces of developing apparatus 40 are included in the rotary 4*a*. Therefore, an interval between the adjacent pieces of developing apparatus 40 becomes narrower when compared with the case in which the four pieces of developing apparatus are arranged in the rotary in the conventional typical four-full-color image forming apparatus. The narrower interval has an influence on the arrangement of the replenishment agent supply path H.

Figure 11:
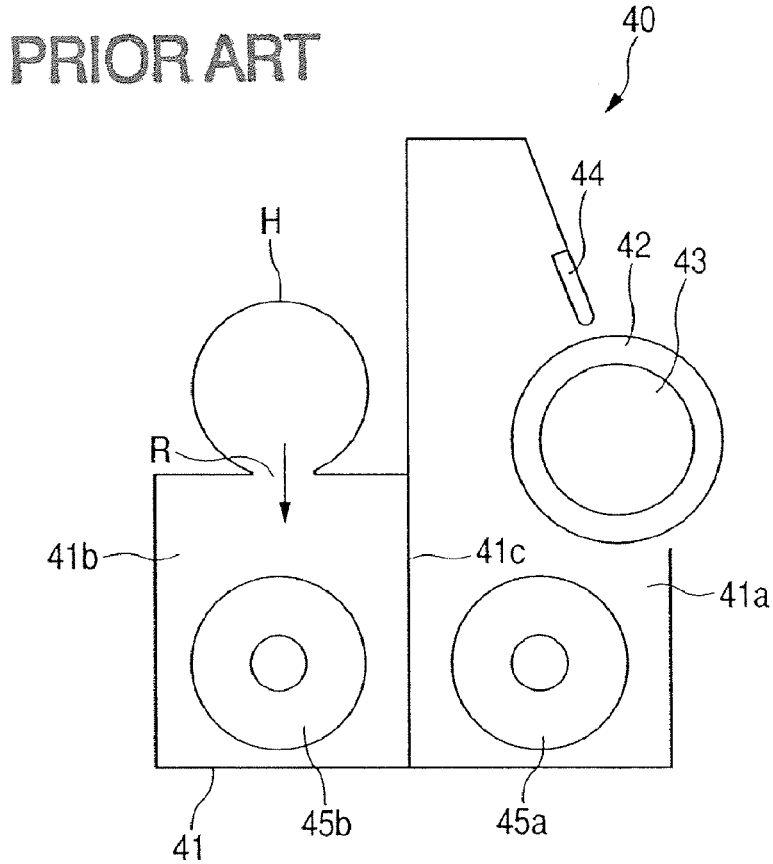
FIG. 11 is a schematic sectional view showing an example of the conventional developing apparatus.
Figure 12:
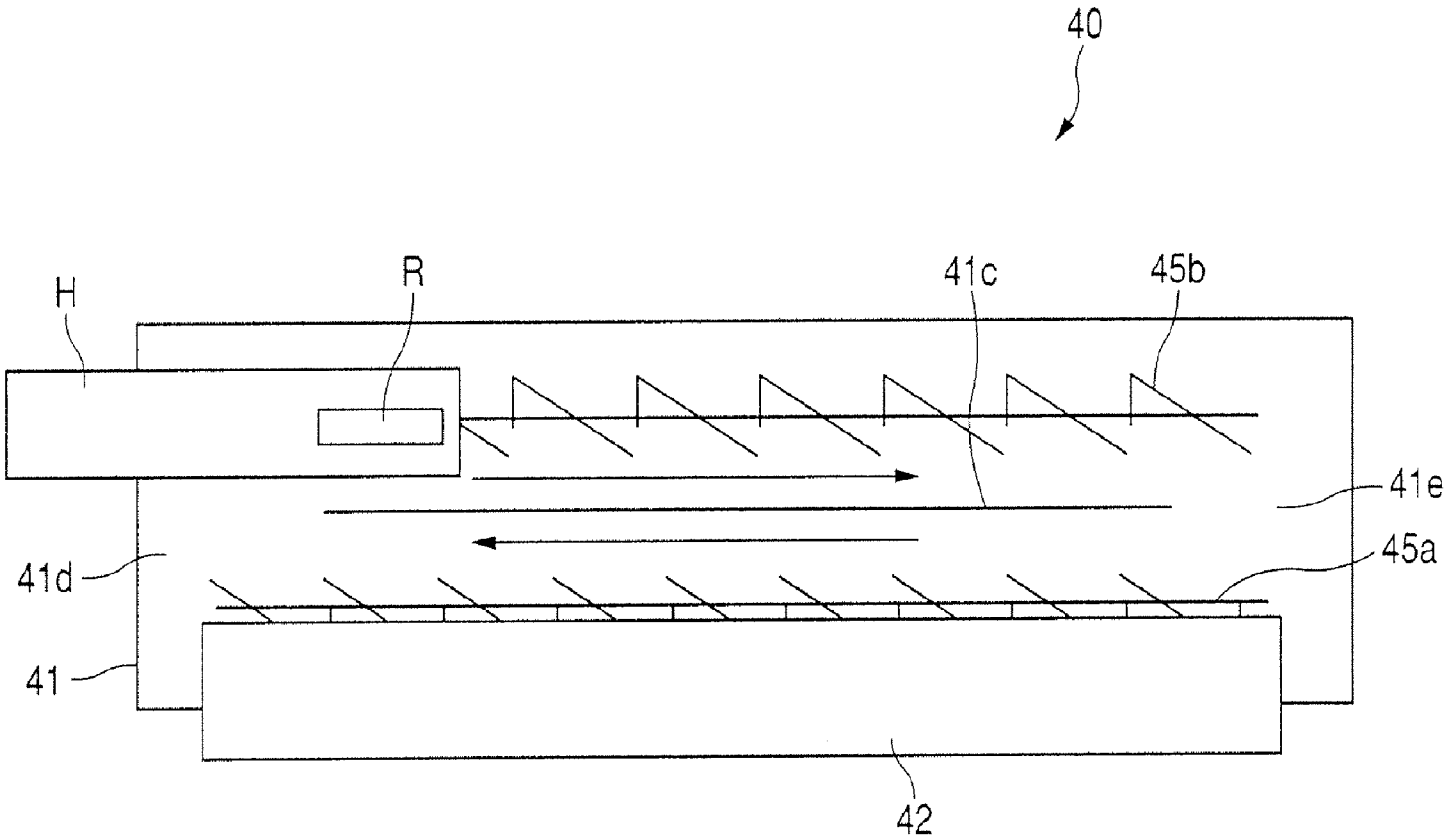
PRIOR ART FIG. 12
FIG. 12 is a plan view showing the inside of the developing container of the conventional developing apparatus.

In the conventional developing apparatus 40, as shown in FIGS. 11 and 12, the developing apparatus 40 is often arranged at the position (substantially horizontal position) opposing the photosensitive member. The replenishment agent supply path H is arranged directly above the second screw 45*b*, and the replenishment agent is supplied while replenishment agent falls from the replenishment agent supply path H to the agitation room 41*b* in which the second screw 45*b* is arranged (usually the replenishment agent is supplied only when the developing apparatus 40 is located at the opposite position (development position) to the photosensitive member).

On the other hand, the rotary system like the first embodiment provided for the six colors, the arrangement of the replenishment agent supply path H is restricted. Therefore, as shown in FIGS. 2 and 3, the replenishment agent supply path H is shifted from directly above the second screw 45*b* when the developing apparatus 40 is located at the position (substantially horizontal position) opposing the photosensitive member. The replenishment agent supply path H is arranged on the rotating center side of the rotary 4*a* (left side from directly above developing container 41 in the drawings) from directly above the developer containing part (in this case, particularly agitation room 41*b*). A regulation surface (slope) I which regulates the replenishment agent conveyance (falling) direction is formed to the agitation room 41*b* from the replenish aperture R which is of the coupling portion between the replenishment agent supply path H and the developing container 41.

Figure 10:
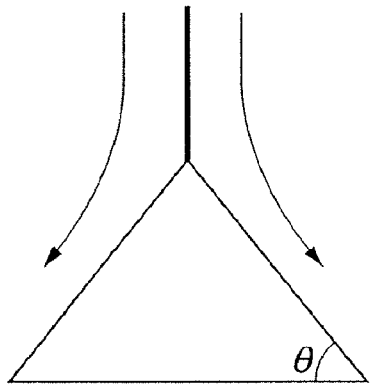
FIG. 10 is a schematic view for explaining a response angle of a developer.

The slope I is inclined relative to the horizon when the replenishment agent is supplied to the developer containing part (in this case, particularly agitation room 41*b*). Particularly, when the slope I is formed at an angle larger than a response angle of the replenishment agent, the replenishment agent can be prevented from stopping in the middle of the slope I without slipping down from the slope I. At this point, the response angle of the replenishment agent means an angle θ which formed by a slope of a mountain and a horizontal plane when the replenishment agent quietly falls to make the mountain as shown in FIG. 10. In the first embodiment, the inclined angle of the slope I is set at 70° while the response angle of the replenishment agent is 50°.

However, in the case of the adoption of the method of replenishing the replenishment agent through the slope I, the shape in which the rebound developer is difficult to return to the developer containing part (in this case, particularly agitation room 41*b*) due to the gravity remains the same. Therefore, the rebound developer is easy to accumulate in the replenishment portion A, and for example the rebound developer enters the replenishment agent supply path H from the replenish aperture R. When the rebound developer gradually clogs up the replenish aperture R or the replenishment agent supply path H, there is a fear that the supply of the replenishment agent is disrupted.

In the first embodiment, screw pitches of the first screw 45*a* and the second screw 45*b* are set at 15 mm, screw diameters of the first screw 45*a* and the second screw 45*b* are set at 20 mmϕ, and screw rotating speeds of the first screw 45*a* and the second screw 45*b* are set at 320 rpm.

2. Replenishment Agent Clogging by Carrier Content of Replenishment Agent

The first embodiment introduces the mechanism, in which the degraded carrier is recovered in each small amount and the carrier is replenished by newly mixing the carrier in the replenishment agent for the recovered carrier, and thereby the trouble of the developer exchange is avoided while the performance of the carrier which is of the charge imparting agent is maintained to some extent.

When the toner is consumed by the image formation, the toner having the same amount equal to the consumed toner is replenished from the developer replenishment tank (not shown) through the replenishment agent supply path H. In the first embodiment, the replenishment agent supplied from the developer replenishment tank is one in which mainly the toner and the carrier are mixed together, and the new carrier is replenished into the developing container 41 while the replenishment agent compensates the toner amount consumed by the image formation.

When the new carrier is replenished into the developing container 40, the developer amount existing in the developing container 40 is increased. However, the increased developer amount is discharged from an exhaust port (not shown) provided in the wall surface of the developing container 40. The position of the exhaust port is adjusted such that the developer amount is stabilized at 375 g in the developing container 40. The discharged developer is collected in a recovery screw (not shown) provided in the center of the rotary 4*a* and collected in a waste toner container (not shown).

In the first embodiment, in the replenishment agent with which the developer replenishment tank is filled, the mixture ratio of the toner and the carrier is set at about 85:15 in terms of weight, and the carrier content (CD ratio) is set at 15%. However, the CD ratio is not limited to 15%.

Figure 13:
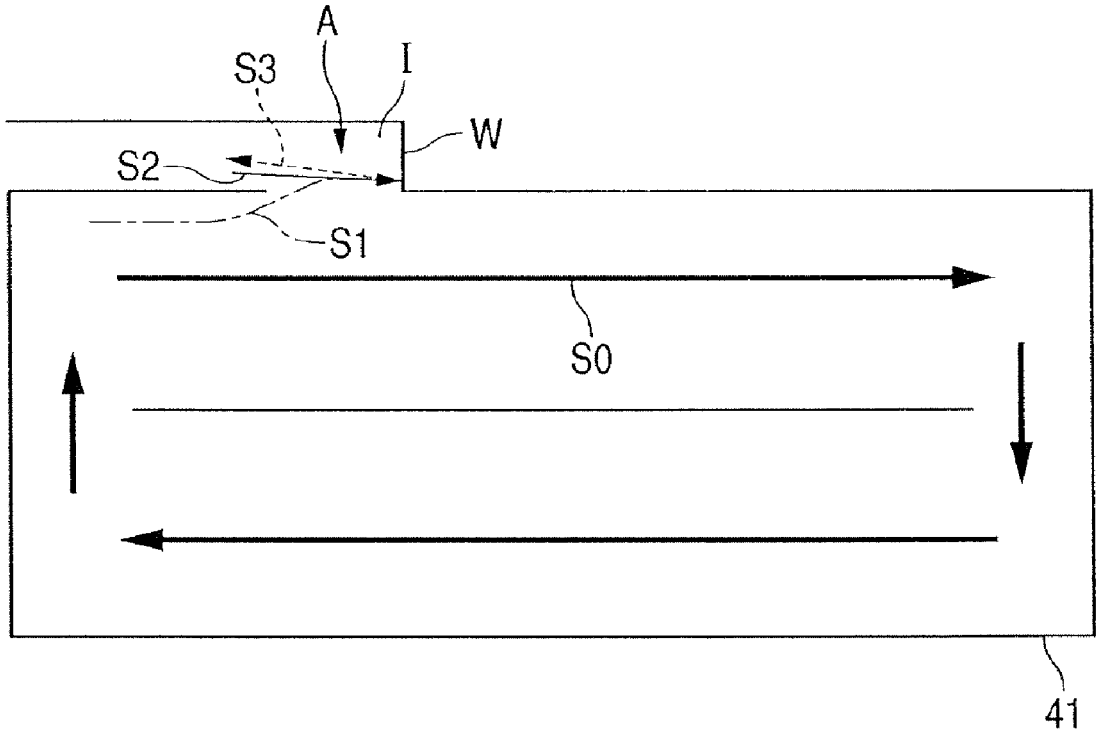
PRIOR ART FIG. 13
FIG. 13 is a schematic view for explaining a flow of the developer near a replenish aperture.

When the carrier content in the replenishment agent is larger than that of the conventional replenishment agent (the conventional carrier content is 0%) like the first embodiment, the following event occurs. The concentration of the carrier whose rebound coefficient is usually higher than that of the toner is increased in the above-described marginal flows, i.e., in the developer containing part facing to the replenishment portion A, i.e., in the marginal flows (S1 and S2) generated in association with the developer conveyance flow S0 in the agitation room 41*b* (FIG. 13). Therefore, the amount of rebound developer tends to be increased. Accordingly, for example, the rebound developer enters the replenishment agent supply path H from the replenish aperture R, and there is a fear that the supply of the replenishment agent is disrupted by gradually clogging up the replenish aperture R or the replenishment agent supply path H with the rebound developer.

[Prevention of Replenishment Agent Clogging Near Replenish Aperture]

In view of the foregoing, in the first embodiment, the replenishment agent supply path will be described in detail below.

Figure 3:
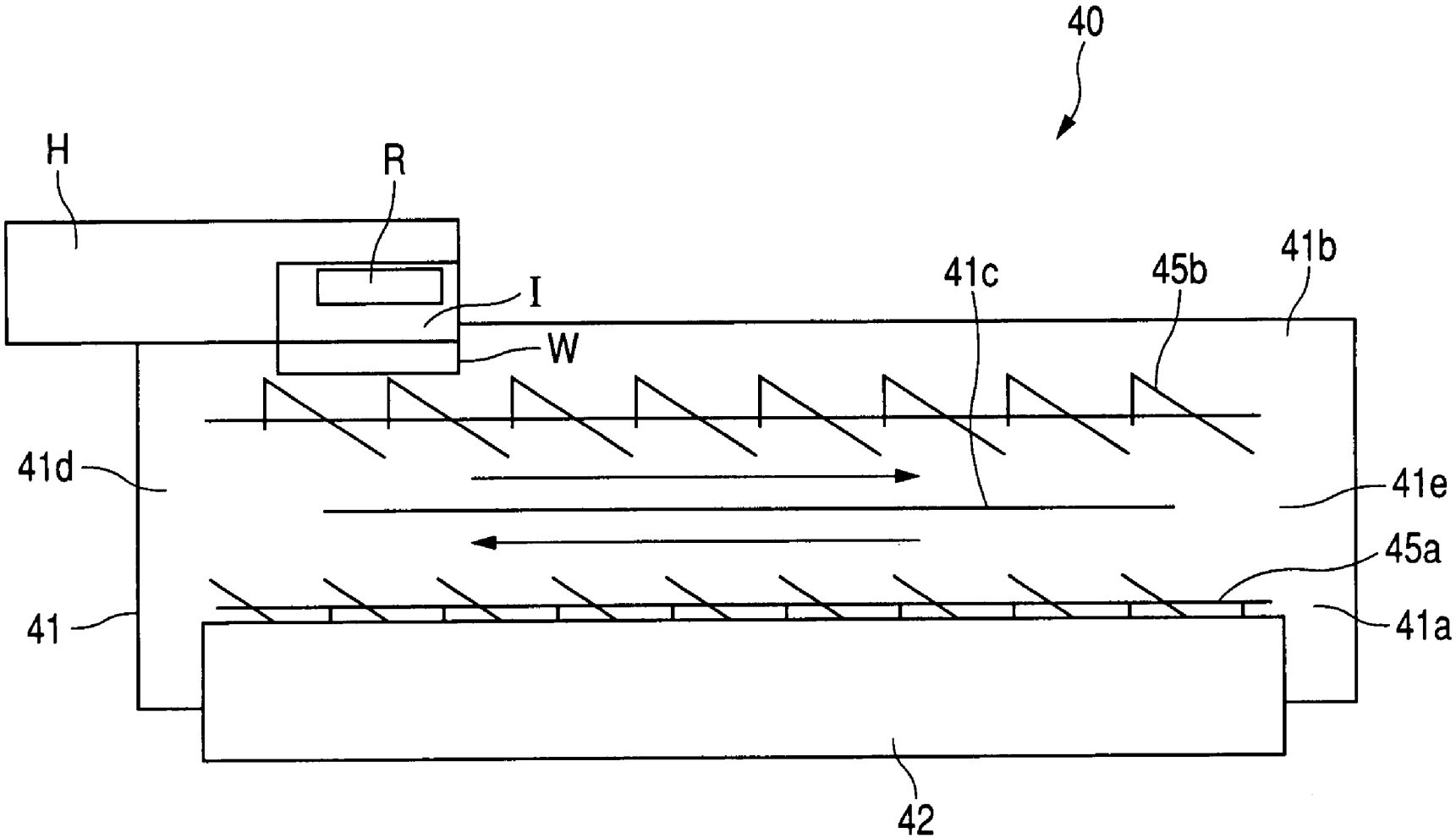
FIG. 3 is a plan view showing an inside of a developing container of the developing apparatus shown in FIG. 2.

Referring to FIGS. 2 and 3, as described above, the developing container 41 of the developing apparatus 40 has the developer containing parts (developing room 41*a* and agitation room 41*b*) while accommodating the developer. The developer is circulated and conveyed in the developer containing part. The replenish aperture R is formed in the coupling portion between the developing container 41 and the replenishment agent supply path H. The replenishment agent from the replenishment agent supply path H passes through the replenish aperture R. The replenishment agent supply path H conveys the replenishment agent supplied to the developer containing parts 41*a* and 41*b*.

Further, as described above, the replenishment portion A is provided in the developing container 41. The replenishment portion A has the regulation surface (slope) I on which the replenishment agent passing through the replenish aperture R slips down. In the replenishment portion A, the replenishment agent passing through the slope I joins the developer in the developer containing part (in this case, particularly agitation room 41*b*). The slope I is formed as a part of the wall surface of the developing container 41.

Figure 4:
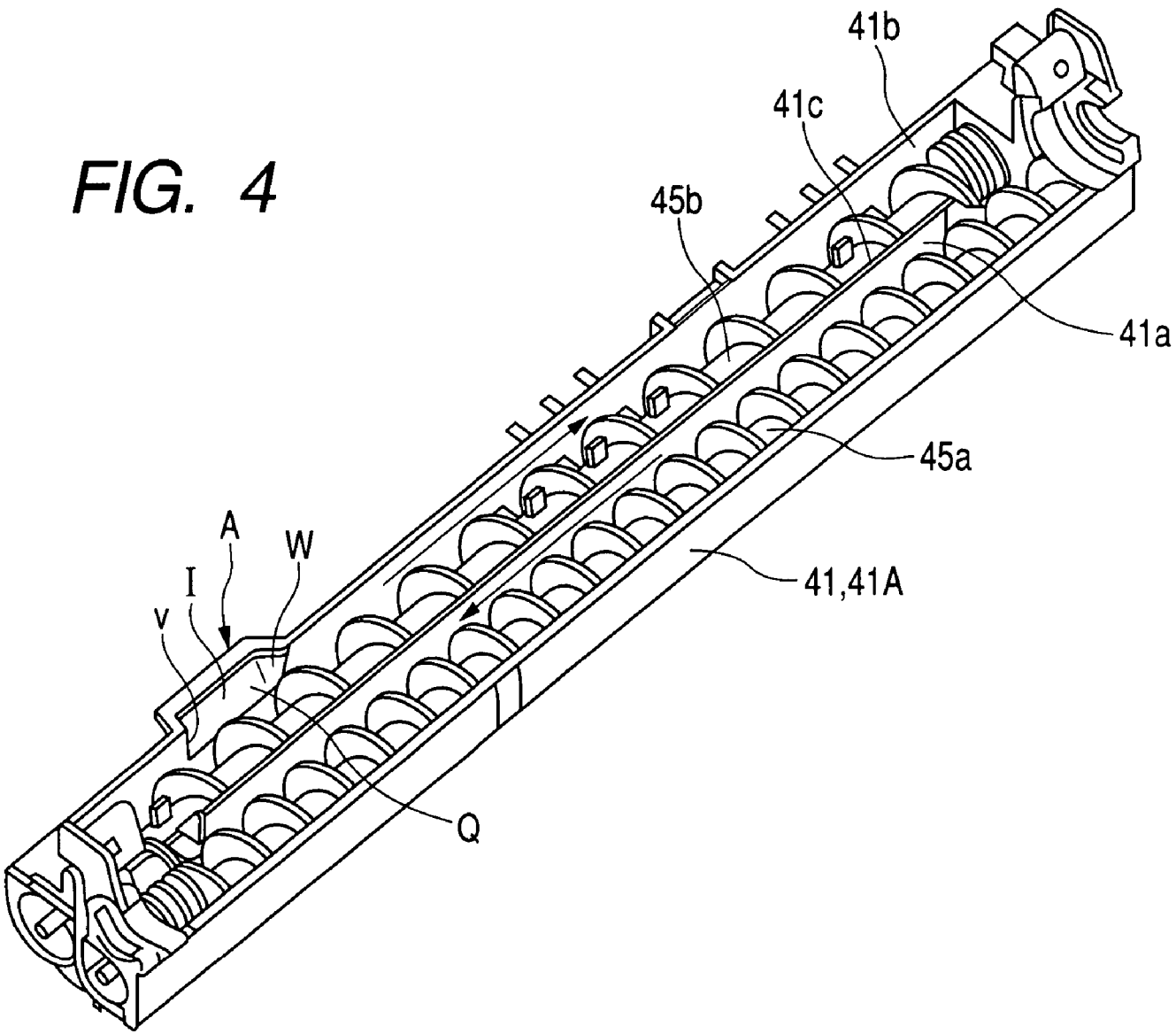
FIG. 4 is a perspective view showing the developing container.
Figure 5:
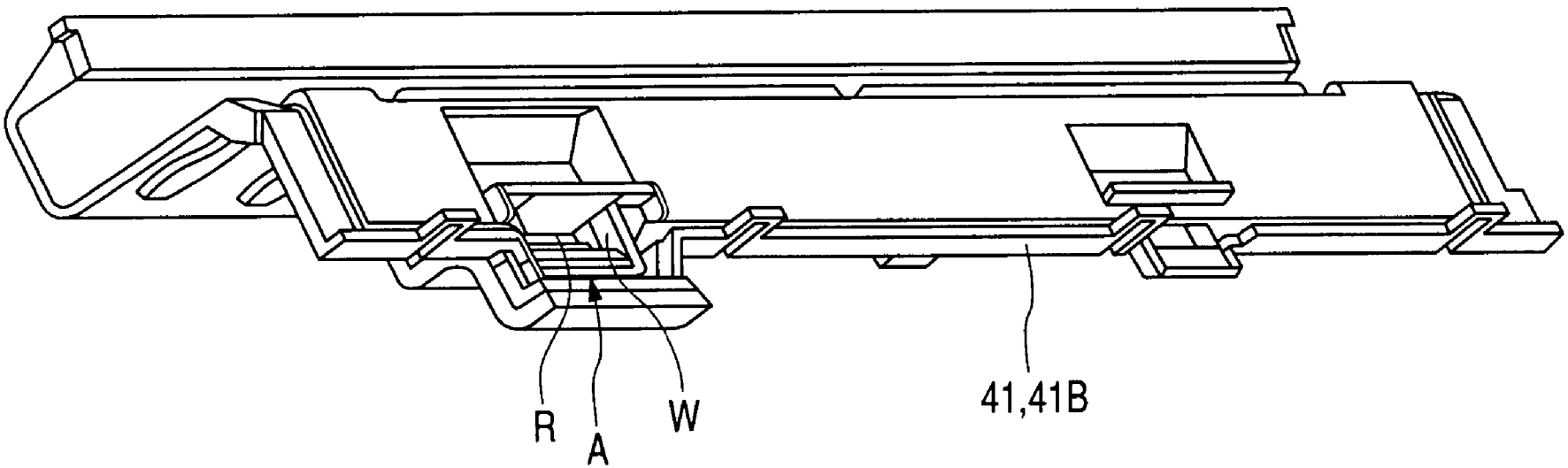
FIG. 5 is a perspective view showing a cover of the developing container.

FIG. 4 and FIG. 5 show a more detail embodiment of the developing container 41. FIG. 4 shows a first frame member 41A of the developing container 41, and the first frame member 41A includes the developer containing parts 41*a* and 41*b*, the first and second screws 45*a* and 45*b*, and the like. FIG. 5 shows a second frame member (developing container cover) 41B of the developing container 41. The second frame member 41B is coupled to the first frame member 41A while capped on the first frame member 41A shown in FIG. 4.

As can be seen from FIGS. 4 and 5, in the first embodiment, the replenish aperture R is formed directly above the slope I of the replenishment portion A. The replenishment portion A is opened toward the inside of the agitation room 41*b* by an opening Q facing to the slope I. The replenishment portion A formed by continuously connected to the inner surface of the developer containing part with the slope I, the wall surface (downstream-side wall surface) W on the downstream side in the developer conveyance direction within the agitation room 41*b* and the upstream-side wall surface v, constitutes a conveyance space of the replenishment agent to slip the replenishment agent down on the slope I and move into the developer containing part (in this case, particularly agitation room 41*b*) after the replenishment agent falls from the replenish aperture R.

In the first embodiment, the developer containing part facing to the replenishment portion A, i.e., the wall surface (downstream-side wall surface) W of the replenishment portion A located on the downstream side in the developer conveyance direction arrow direction in FIGS. 3 and 4) within the agitation room 41*b* is formed by inclined toward the developer conveyance direction.

More particularly, an angle T is set at 70° in the first embodiment, when an orientation of the downstream-side wall surface W is defined by the angle T (angle between wall surface-developer conveyance direction) formed by the downstream-side wall surface W and the developer containing part facing to the replenishment portion A, i.e., a plane parallel to the developer conveyance direction in the agitation room 41*b*.

TABLE 1 shows verification results of effect when the angle T is changed. The inclined angle of the slope I (angle formed by the slope I and the horizontal plane when the replenishment agent is supplied), which regulates the toner falling (conveyance) direction from the replenish aperture R, is set at 90° (conventional example: perpendicular and no slope) and 70° (First embodiment: inclination and presence of slope). The carrier content (CD ratio) of the replenishment agent is set at 0% (conventional example) and 15% (first embodiment). The angle T is set at 90° (conventional example: no taper and perpendicular) and 70° (First embodiment: presence of taper and inclination). TABLE 1 shows a level of the replenishment agent clogging generation near the replenish aperture R. With reference to the replenishment agent clogging generation near the replenish aperture R, when the image density is extremely decreased during an endurance test of the image forming apparatus, it is evaluated that the replenishment agent clogging is generated. In the evaluation result, the density of a solid patch portion (reference image of maximum density: diameter of 8 mm) in the endurance image is measured with a reflection density meter (X-rite), and it is determined that the clogging is generated near the replenish aperture when the density is decreased from the value of 1.6 in the normal state to values not more than 1.4. In TABLE 1, the evaluation result is indicated. In this Table, "GOOD" indicates the clogging near Replenish Aperture is not generated, while "NG" indicates the clogging near Replenish Aperture is generated in 10 k endurance test and "BAD" indicates the clogging near Replenish Aperture is generated in 1 k endurance test. The image formation test is performed with 10,000 sheets of A4 size recording materials and the image formation test is performed with 1000 sheets of A4 size recording materials.

TABLE 1

| Presence or absence of replenishment agent carrier | Replenish aperture toner falling (conveyance) direction | No taper | Presence of taper |
|---|---|---|---|
| Absence | Perpendicular | GOOD | GOOD |
| Presence | Perpendicular | NG | GOOD |
| Absence | Oblique | NG | GOOD |
| Presence | Oblique | BAD | GOOD |

From the result shown in TABLE 1, when the angle T is perpendicular, it can be confirmed that the replenishment agent clogging is easiest to occur near the replenish aperture R in the system in which the carrier exists in the replenishment agent and the toner falls (conveyance) from the replenish aperture R by the slope.

On the other hand, in the case the angle T is 70°, it can be confirmed that the replenishment agent clogging is not generated near the replenish aperture R.

TABLE 2 shows the verification results in the system in which the replenishment agent clogging is easy to occur near the replenish aperture R. In the system, the replenishment agent includes the carrier, and the slope which regulates the toner falling (conveyance) direction from the replenish aperture R exists. TABLE 2 shows the verification results of the effect when the angle T varies in order to eliminate the replenishment agent clogging near the replenish aperture R in the system.

The replenishment agent clogging near the replenish aperture R is evaluated as described above. With reference to replenishment agent accumulation in dead space in TABLE 2, when the portion having the high toner density exists near the replenish aperture while the developer and the replenishment agent are not mixed together in the developer containing part, it is evaluated that the replenishment agent accumulation in dead space is present. Because the colors and flow behaviors of the developer and the replenishment agent in the developer containing part are different from each other, when color shading of the developer or the bad flow behavior is present in the developer by visual inspection in the developing apparatus, it is determined that the replenishment agent accumulation is present in the dead space. The replenishment agent has the color similar to or close to the toner color, and the large amount of carrier is included in the developer in the developing apparatus, so that the carrier is dark. Therefore, it can be determined by the visual inspection in the developing apparatus whether the developer and the replenishment agent are mixed together or not. With reference to the flow behavior, the developer in the developer containing part has the high flow behavior, and the replenishment agent has the low flow behavior because the toner is rich. Accordingly, even in the black developing apparatus in which the determination is difficult to be made by the color, whether the replenishment agent accumulation in the dead space is present or absent can be determined by visual observation of the location where the flow behavior is bad. In TABLE 2, the evaluation result is indicated. In this Table, "GOOD" indicates the clogging near Replenish Aperture or Replenishment Agent Accumulation in Dead Space is not generated, while "NG" indicates the clogging near Replenish Aperture or Replenishment Agent Accumulation in Dead Space or generated is generated in 10 k endurance test and "BAD" indicates the clogging near Replenish Aperture is generated in 1 k endurance test. The image formation test is performed with 10,000 sheets of A4 size recording materials and the image formation test is performed with 1000 sheets of A4 size recording materials.

TABLE 2

| | Angle T between wall surface and developer conveyance direction | | | | | | | | | |
|---|---|---|---|---|---|---|---|---|---|---|
| | 90° | 80° | 70° | 60° | 50° | 40° | 30° | 20° | 10° | 0° |
| Replenish aperture clogging | BAD | NG | GOOD | GOOD | GOOD | GOOD | GOOD | GOOD | GOOD | GOOD |
| Replenishment agent accumulation in the dead space | GOOD | GOOD | GOOD | GOOD | GOOD | GOOD | GOOD | GOOD | GOOD | NG |

From the result shown in TABLE 2, when the angle T is set at values not more than 70°, it can be confirmed that the replenishment agent clogging can be avoided near the replenish aperture R.

However, in the state in which the angle T is close to 0°, the large space is made beside the second screw 45*b*. There is a fear that this space becomes the so-called dead space where the conveyance force of the second screw 45*b* cannot range and the developer is not operated at all.

As can be seen from the result of TABLE 1, when the angle T is set at 0°, it is confirmed that the replenishment agent is accumulated in the dead space while the replenishment agent clogging is not generated near the replenish aperture R. Therefore, it is confirmed that the adoption of the angle T of 0° should be avoided.

The above verification results are summarized as follows. The downstream-side wall surface W is formed by being inclined toward the developer containing part facing to the replenishment portion A, i.e., the developer conveyance direction in the agitation room 41*b*, and the angle T ranges from 10°≦70°. Therefore, the replenishment agent clogging can efficiently be avoided near the replenish aperture R. Further, it is also found that the phenomenon in which the replenishment agent is accumulated in the dead space can efficiently be avoided. In order to further decrease the dead space, it is preferable that the angle is set at the maximum angle in which the replenishment agent clogging is not generated near the replenish aperture R. In the first embodiment, the angle T is set at 70° due to the above reasons.

Figure 7:
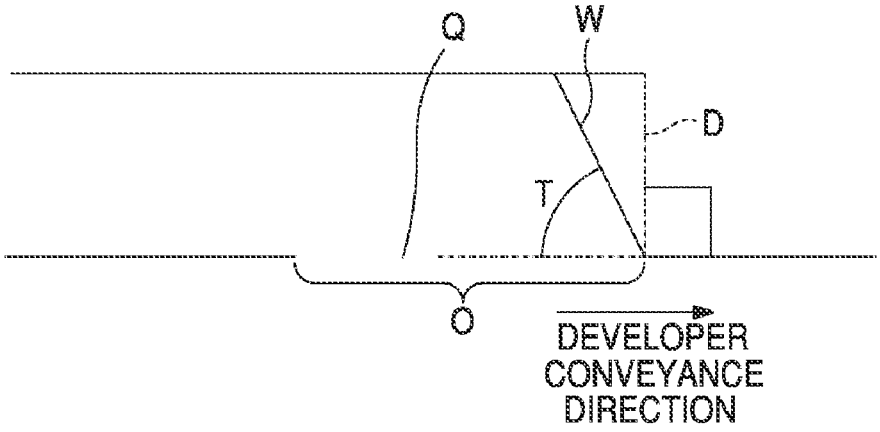
FIG. 7 is a schematic view showing a projective area of a downstream side wall surface.

TABLE 3 shows the effect when D/O is changed. D/O means an area ratio of an area D to an opening area O of the opening Q. The area D is the area of the plane in which the developer containing part facing to the replenishment portion A, i.e., the wall surface (downstream-side wall surface) W of the replenishment portion A. located on the downstream side in the developer conveyance direction within the agitation room 41*b*, is projected onto the plane perpendicular to the developer conveyance direction. The area of the plane in which the downstream-side wall surface W is projected onto the plane perpendicular to the developer conveyance direction is the area shown in FIG. 7. The sectional area of the replenish aperture R is the sectional area in the direction orthogonal to the replenishment agent falling direction (gravity direction) during the supply of the replenishment agent. In TABLE 3, the evaluation result is indicated. In this Table, "GOOD" indicates the clogging near Replenish Aperture is not generated, while "NG" indicates the clogging near Replenish Aperture is generated in 10 k endurance test and "BAD" indicates the clogging near Replenish Aperture is generated in 1 k formation test is performed with 10,000 sheets of A4 size recording materials and the image formation test is performed with 1000 sheets of A4 size recording materials.

TABLE 3

| | D/0 | | | | | | |
|---|---|---|---|---|---|---|---|
| | 0.00 | 0.05 | 0.10 | 0.15 | 0.20 | 0.25 | 0.30 |
| Replenishment aperture clogging | BAD | NG | GOOD | GOOD | GOOD | GOOD | GOOD |

From the result of TABLE 3, in order to obtain the effect by the inclined formation of the downstream-side wall surface W toward the developer containing part facing to the replenishment portion A, i.e., the developer conveyance direction in the agitation room 41*b*, it is confirmed that D/O is preferably set at values not lower than 0.10.

The value of D/O means the following things. As the opening area O of the opening Q is increased, the marginal flows (S1 and S2) generated in association with the developer conveyance flow S0 is increased in the replenishment portion A. The replenishment agent clogging is easy to occur near the replenish aperture R by the collision of the marginal flows (S1 and S2) with the downstream-side wall surface W. On the other hand, when the downstream-side wall surface W is not perpendicular to the developer conveyance direction but the downstream-side wall surface W has the angle with respect to the developer conveyance direction to some extents, as the area D in which the downstream-side wall surface W is projected onto the plane perpendicular to the developer conveyance direction is increased, a possibility that the rebound developer returns to the agitation room 41b is increased. That is, the marginal flows (S1 and S2) passing through the area D in which the downstream-side wall surface W is projected onto the plane perpendicular to the developer conveyance direction is increased in the replenishment portion A, possibility that the marginal flows (S1 and S2) are returned to the agitation room 41*b* is increased. Therefore, the replenishment agent clogging is difficult to occur near the replenish aperture R. Accordingly, as D/O in which an inverse number O and D are multiplied together is increase, the replenish aperture clogging becomes hard to occur. As described above, in order to eliminate the replenishment agent clogging near the replenish aperture R, it is experimentally shown that D/O is preferably larger than 1.0.

Thus, it is confirmed that D/O has the larger effect as D/O becomes larger. However, usually the area D which can be secured in the developing apparatus is restricted, so that O is small when D/O is extremely large. That is, the replenish aperture R is extremely small when D/O is extremely large, and the replenishment agent cannot flow into the developing container 41. Therefore, it is said that an upper limit of D/O is about 0.5. The first embodiment adopts the configuration in which D/O is set at 0.20.

Figure 6:
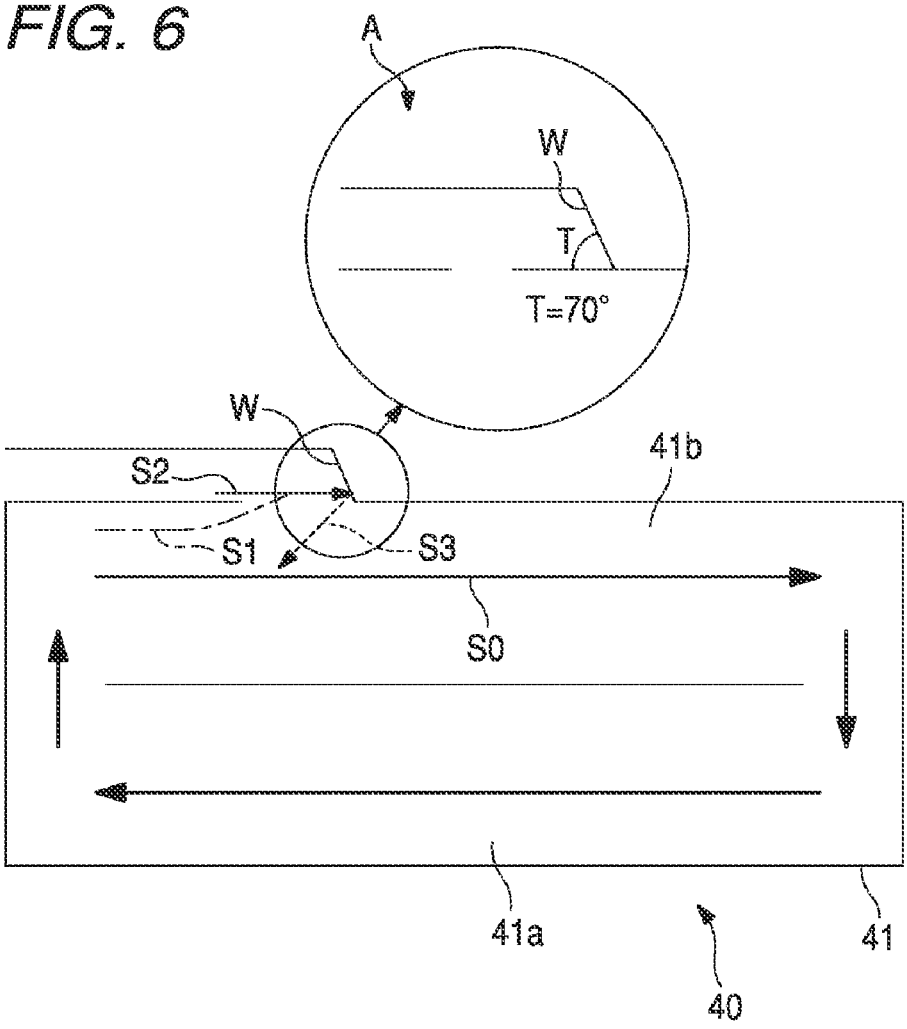
FIG. 6 is a schematic view showing a replenish part.

Although the invention is not constrained by a principle, the reason why the clogging prevention effect is exhibited when the angle T is not more than 70° is considered as follows: As shown in FIG. 6, when the marginal flows (S1 and S2) which are generated in association with the developer conveyance flow S0 is increased in the developer containing part facing to the replenishment portion A, i.e., in the agitation room 41*b* collide with the downstream-side wall surface W, the downstream-side wall surface W is not perpendicular to the developer conveyance direction but the downstream-side wall surface W is faced toward the developer conveyance direction with the angle of some extents, so that the rebound developer flows toward the agitation room 41*b* side. That is, the rebound developer does not flow toward the direction in which the rebound developer enters the replenishment agent supply path H from the replenish aperture R.

Therefore, the slope I which regulates the toner falling direction from the replenish aperture R is provided. Even if the rebound developer has the shape which is difficult to return to the developer containing part by the gravity, the slope I can actively rebound the developer colliding with the downstream-side wall surface W. When the large amount of carrier whose rebound coefficient is generally higher than that of the toner is contained in the replenishment agent, the replenishment agents in the marginal flows collide with the downstream-side wall surface W to rebound into the developer containing part, so that the replenishment agent clogging is not promoted near the replenish aperture R. Accordingly, despite of (i) the replenishment agent falling (conveyance) direction from the replenish aperture R or (ii) the carrier content during the replenishment, it is largely suppressed that the replenishment agent clogging is generated near the replenish aperture R to interrupt the supply of the replenishment agent.

As described above, according to the first embodiment, the replenishment agent clogging can be suppressed in the replenishment agent supply path to the developer containing parts 41*a* and 41*b*.

Second Embodiment

Then, a second embodiment of the invention will be described. The basic configuration and the action of the image forming apparatus according to the second embodiment are similar to the image forming apparatus of the first embodiment. Accordingly, the element having the same function and configuration as the first embodiment or the function and configuration corresponding to the first embodiment is indicated by the same reference numeral as the first embodiment, and the detail description will be neglected.

In the second embodiment, developer conveyance speed is increased in order to adapt to the case in which a process speed of the image forming apparatus is increased by the increase in output speed of the image forming apparatus.

In the second embodiment, both the screw pitches of the first screw 45*a* and the second screw 45*b* in the developing apparatus 40 are set at 15 mm, both the screw diameters of the first screw 45*a* and the second screw 45*b* are set at 20 mmφ, and both the screw rotating speeds of the first screw 45*a* and the second screw 45*b* are set at 640 rpm. That is, the second embodiment differs from the first embodiment in the screw rotating speeds of the first screw 45*a* and the second screw 45*b*, the screw rotating speeds of the second embodiment doubles the screw rotating speed of 320 rpm of the first embodiment to adapt to the increase in process speed of the image forming apparatus by the increase in output speed of the image forming apparatus.

TABLE 4 shows the presence and absence of the replenishment agent clogging near the replenish aperture R in the image forming apparatus 100 of the second embodiment in which the developer conveyance speed is increased while comparing to the first embodiment. The carrier content (CD ratio) of the replenishment agent is set at 15%, and the angle T is set at 70degree. The D/O ratio is set at 0.20, where D is the area of the plane in which the downstream-side wall surface W is projected onto the plane perpendicular to the developer conveyance direction and O is the opening area of the opening Q. The first embodiment and the second embodiment have the common configuration except for the screw rotating speeds of the first screw 45*a* and the second screw 45*b*.

TABLE 4

| | Screw rotating speed | |
|---|---|---|
| | 320 rpm | 640 rpm |
| Replenish aperture clogging | GOOD | NG |

In this Table 4, "GOOD" indicates the clogging near Replenish Aperture is not generated, while "NG" indicates the clogging near Replenish Aperture is generated in 10 k endurance test and "BAD" indicates the clogging near Replenish Aperture is generated in 1 k endurance test. The image formation test is performed with 10,000 sheets of A4 size recording materials and the image formation test is performed with 1000 sheets of A4 size recording materials.

From TABLE 4, in the system in which the developer conveyance speed is increased like the second embodiment, it is confirmed that the replenishment agent clogging is generated near the replenish aperture R. Although the invention is not constrained by the principle, the following reason is considered.

Figure 8A:
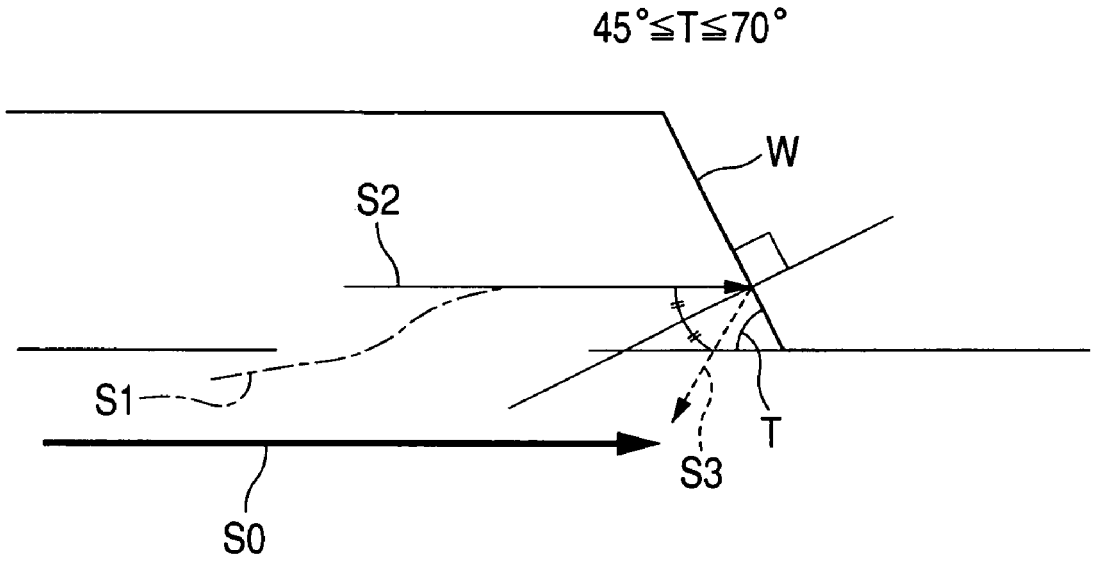
FIGS. 8A and 8B are schematic views for explaining a rebound direction of a secondary rebound developer.
Figure 8B:
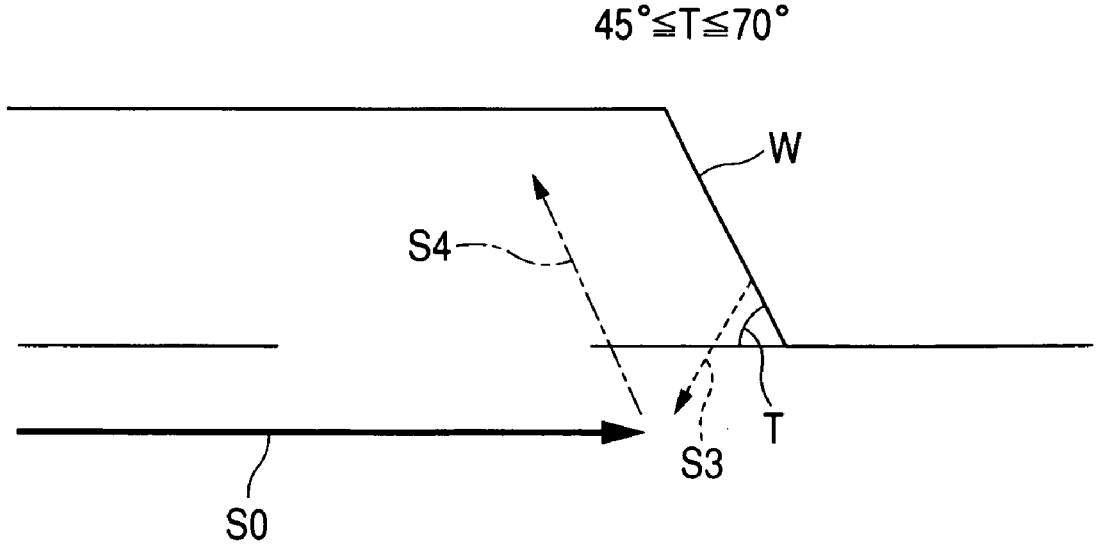

As shown in FIG. 8A and FIG. 8B, when the angle T formed by the developer containing part facing to the replenishment portion A, i.e., the wall surface (downstream-side wall surface) W of the replenishment portion A on the downstream side in the developer conveyance direction in the agitation room 41*b* and the plane parallel to the developer conveyance direction is not more than 70°, all the rebound angles of the rebound developer from the downstream-side wall surface W are faced toward the developer containing part (in this case, agitation room 45*b*) side.

However, when the angle T is not lower than 45°, the rebound direction of the rebound developer is in the state in which the rebound direction of the rebound developer collides with the developer conveyance direction in the agitation room 45*b*. That is, when a moving component of the rebound developer is divided into the component in the developer conveyance direction in the developer containing part and the component perpendicular to the developer conveyance direction component, the component in the directly opposite direction to the developer conveyance direction in the developer containing part exists. Therefore, in the system in which the developer conveyance speed is increased, a secondary rebound developer (S4) generated by the collision enters the replenishment agent supply path H from the replenish aperture R, which causes the toner clogging.

Figure 9A:
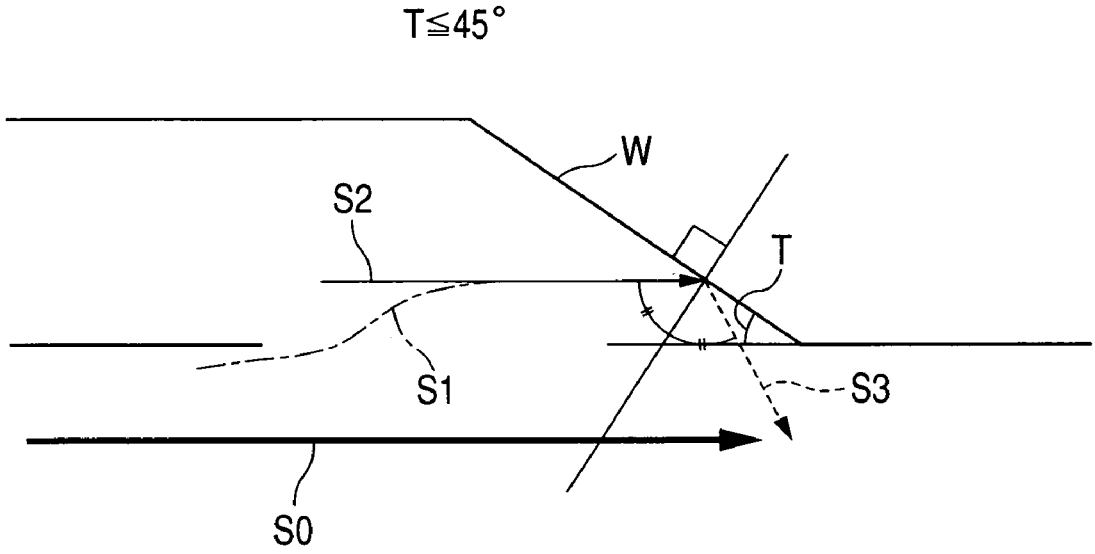
FIGS. 9A and 9B are schematic views for explaining the rebound direction of the secondary rebound developer.
Figure 9B:
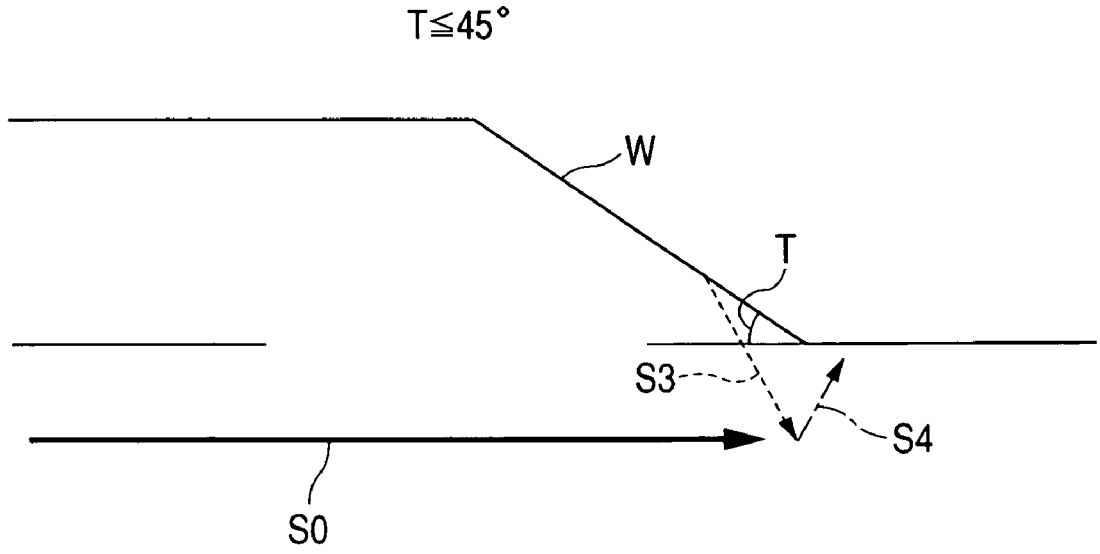

However, as shown in FIG. 9A and FIG. 9B, when the angle T is not more than 45°, the rebound direction of the rebound developer does not become the state in which the rebound direction of the rebound developer collides with the developer conveyance direction in the agitation room 45*b*. That is, when the moving component of the rebound developer is divided into the component in the developer conveyance direction in the developer containing part and the component perpendicular to the developer conveyance direction component, the component in the directly opposite direction to the developer conveyance direction in the developer containing part does not exist. Therefore, even in the system in which the developer conveyance speed is increased, it can be avoided that the secondary rebound developer (S4) generated by the collision enters the replenishment agent supply path H from the replenish aperture R to cause the toner clogging.

TABLE 5 shows the verification results of the replenishment agent clogging near the replenish aperture R when the angle T varies at the screw rotating speed of 640 rpm of the second embodiment.

TABLE 5

| | Angle T between wall surface and developer conveyance direction | | | | | | | | | | |
|---|---|---|---|---|---|---|---|---|---|---|---|
| | 90° | 80° | 70° | 60° | 50° | 45° | 40° | 30° | 20° | 10° | 0° |
| Replenish aperture clogging | BAD | BAD | NG | NG | NG | GOOD | GOOD | GOOD | GOOD | GOOD | GOOD |
| Replenishment agent accumulation in the dead space | GOOD | GOOD | GOOD | GOOD | GOOD | GOOD | GOOD | GOOD | GOOD | GOOD | NG |

In Table 5, "GOOD" indicates the clogging near Replenish Aperture or Replenishment Agent Accumulation in Dead Space is not generated, while "NG" indicates the clogging near Replenish Aperture or Replenishment Agent Accumulation in Dead Space or generated is generated in 10 k endurance test and "BAD" indicates the clogging near Replenish Aperture is generated in 1 k endurance test. The image formation test is performed with 10,000 sheets of A4 size recording materials and the image formation test is performed with 1000 sheets of A4 size recording materials.

From TABLE 5, when the angle T is not more than 45°, even in the system in which the developer conveyance speed is increased, it can be confirmed that the phenomenon in which the rebound developer (S4) generated by the collision of the rebound developer with the developer in the agitation room 45*b* enters the replenishment agent supply path H from the replenish aperture R to cause the toner clogging is avoided. Like the first embodiment, in order not to generate the replenishment agent accumulation in the dead space, it can be confirmed that the angle T is preferably not lower than 10°.

Thus, when the angle T is not more than 45°, despite of (i) the replenishment agent falling (conveyance) direction from the replenish aperture R, (ii) the carrier content during the replenishment, or (iii) the developer conveyance speed, it can be largely suppressed that the replenishment agent clogging is generated near the replenish aperture R to interrupt the supply of the replenishment agent. Further, when the angle T is not lower than 10°, it can be largely suppressed that the replenishment agent is accumulated in the dead space.

As described above, according to the second embodiment, the replenishment agent clogging can be suppressed more securely in the replenishment agent supply path to the developer containing parts 41*a* and 41*b*.

The case in which the developer Used in the developing apparatus is the two-component developer is described in the above embodiments. However, the invention is not limited to the two-component developer, but the invention can be applied to the case of the use of one-component developer which substantially includes only the toner.

In the above embodiments, the replenishment agent includes the toner and the carrier. However, the invention is not limited to the above embodiments, but the invention can be applied to the case in which the replenishment agent which substantially includes only the toner. With reference to the carrier replenishing method, the carrier may independently be replenished, and the replenish aperture dedicated to the carrier may be provided in order to independently replenish the carrier. That is, the invention preferably functions when the replenishment agent includes at least one of the toner and the carrier.

In the above embodiment, the plural pieces of developing apparatus are provided in one image bearing member, and particularly the plural pieces of developing apparatus are held in the rotating member (rotary) which is of the developing apparatus holding member. As described above, the invention is extremely effective when the large number (at least five, preferably at least six) of pieces of developing apparatus more than the four pieces of developing apparatus included in the conventionally general image forming apparatus is provided in the rotating member. However, the invention is not limited to this mode. For example, the invention can also be applied to the image forming apparatus including one image bearing member and one piece of developing apparatus, or the image forming apparatus having the plural image forming portions which includes the image bearing member and the developing apparatus.

In the embodiments, the image forming apparatus adopts the intermediate transferring method. However, the invention is not limited to the intermediate transferring method at all. As is well known among those skilled in the art, there is the image forming apparatus which forms the full-color image. The image forming apparatus has a recording material bearing member which is circularly moved with respect to the while bearing the recording material, the developer images (toner images) including the plural kinds (colors) of developers are formed in the recording material on the recording material bearing member while superposing one another, and the developer images are fixed. The invention can also be applied to the above type image forming apparatus.

This application claims priority from Japanese Patent Application No. 2004-306178 filed on Oct. 20, 2004, which is hereby incorporated by reference herein.

What is claimed is:

1. A developing apparatus comprising:

a developer containing part adapted to contain a developer;

a conveyance member rotatably provided in said developer containing part, wherein said conveyance member conveys the developer in a predetermined direction along a rotation axis of said conveyance member in said developer containing part;

a replenishment agent supply path in the same direction as the rotation axis of said conveyance member adapted to supply a replenishment agent to said developer containing part through a replenish aperture;

a replenishment portion which connects said replenishment agent supply path with said developer containing part to join the replenishment agent supplied from said replenishment agent supply path into said developer containing part, said replenishment portion having a regulation surface, the replenishment agent being supplied from said replenish aperture slipping down on said regulation surface; and a wall surface adjacent to the regulation surface, wherein the wall surface is located on a downstream side of the regulation surface in the predetermined direction and is formed to be inclined with respect to the predetermined direction so that a side of said wall surface near to said developer containing part is located downstream of a side of said wall surface far from said developer containing part in the predetermined direction.

2. A developing apparatus according to claim 1, wherein an angle formed by said wall surface and a plane parallel to both a gravitational direction and the direction along the rotation axis is within the range equal to or more than 10 degrees and equal to or less than 70 degrees.

3. A developing apparatus according to claim 2, wherein the angle formed by said wall surface and the plane parallel to both a gravitational direction and the direction along the rotation axis is within the range equal to or more than 10 degrees and equal to or less than 45 degrees.

4. A developing apparatus according to claim 1, wherein said regulation surface is inclined to a horizontal plane.

5. A developing apparatus according to claim 1, wherein the developer in said developer containing part includes toner and a carrier.

6. A developing apparatus according to claim 1, wherein the replenishment agent includes at least one of the toner and the carrier.

7. A developing apparatus according to claim 1, wherein a ratio of an area in which said wall surface is projected onto a plane perpendicular to the direction in which the developer is conveyed, to an area of opening portion to replenish the replenishment agent into said developer containing part is equal to or more than 0.10.

8. A developing apparatus comprising:

a developer containing part adapted to contain a developer;

a conveyance member rotatably provided in said developer containing part, wherein said conveyance member conveys the developer in a predetermined direction along a rotation axis of said conveyance member in said developer containing part;

a replenishment agent supply path in the same direction as the rotation axis of said conveyance member adapted to supply a replenishment agent to said developer containing part through a replenish aperture;

a replenishment portion which connects said replenishment agent supply path with said developer containing part to join the replenishment agent supplied from said replenishment agent supply path into said developer containing part, said replenishment portion having a regulation surface, the replenishment agent being supplied from said replenish aperture slipping down on said regulation surface; and a wall surface adjacent to the regulation surface, wherein the wall surface located on a downstream side of the regulation surface in the predetermined direction is formed to be inclined from a point adjacent to said developer containing part and with respect to the predetermined direction so that a side of said wall surface near to said developer containing part is located downstream of a side of said wall surface far from said developer containing part in the predetermined direction.

* * * * *

UNITED STATES PATENT AND TRADEMARK OFFICE

CERTIFICATE OF CORRECTION

PATENT NO. : 7,362,989 B2
APPLICATION NO. : 11/246184
DATED : April 22, 2008
INVENTOR(S) : Tadayoshi Nishihama et al.

It is certified that error appears in the above-identified patent and that said Letters Patent is hereby corrected as shown below:

COLUMN 1:
Line 32, "replenishing," should read --replenishing--.

COLUMN 2:
Line 14, "part" should read --part.--.
Line 44, "though" should read --thought--.

COLUMN 3:
Line 13, "thee" should read --there--.
Line 65, "developer." should read --developer;--.

COLUMN 7:
Line 34, "to ward" should read --toward--.
Line 52, "An" should read --A--.
Line 62, "40 mm" should read --40 μm--.
Line 64, "100 mm" should read --100 μm--.
Line 66, "determined" should read --determined in the--.

COLUMN 11:
Line 50, "detail" should read --detailed--.
Line 65, "by" should read --by being--.

COLUMN 12:
Line 13, "by" should read --by being--.

COLUMN 14:
Line 51, "portion A." should read --portion A,--.
Line 66, "1 k" should read --1 k endurance test. The image--.

COLUMN 15:
In Table 3, "D/0" should read --D/O--.
Line 44, "increase," should read --increased,--.

Signed and Sealed this

Sixth Day of July, 2010

David J. Kappos

David J. Kappos
*Director of the United States Patent and Trademark Office*

COLUMN 16:

Line 40, “detail” should read --detailed--.
Line 65, “70degree.” should read --70°.--.

COLUMN 19:

Line 1, “Used” should read --used--.
Line 39, “to the while” should read --to the image bearing member while--.